US005943532A

United States Patent [19]

Ohnuma

[11] Patent Number: 5,943,532

[45] Date of Patent: Aug. 24, 1999

[54] IMAGE FORMING APPARATUS

[75] Inventor: Satoshi Ohnuma, Kawasaki, Japan

[73] Assignee: Kabushiki Kaisha Toshiba, Kawasaki, Japan

[21] Appl. No.: 09/158,286

[22] Filed: Sep. 22, 1998

[30] Foreign Application Priority Data

Sep. 22, 1997 [JP] Japan ..... 9-275112

[51] Int. Cl.[6] ..... G03G 15/00

[52] U.S. Cl. ..... 399/167; 399/299; 399/303; 399/306

[58] Field of Search ..... 399/167, 162, 399/299, 303, 306, 88

[56] References Cited

U.S. PATENT DOCUMENTS

| | | | |
|---|---|---|---|
| 4,541,709 | 9/1985 | Kampschreur | 399/162 |
| 4,723,145 | 2/1988 | Takada et al. | 399/36 |
| 4,816,844 | 3/1989 | Uchida . | |
| 5,111,242 | 5/1992 | Tanimoto et al. | 399/167 |
| 5,365,324 | 11/1994 | Gu et al. | 399/299 |
| 5,592,261 | 1/1997 | Yoshino | 399/167 |
| 5,652,942 | 7/1997 | Iseki et al. | 399/299 X |

FOREIGN PATENT DOCUMENTS

| | | |
|---|---|---|
| 62-146849 | 6/1987 | Japan . |

*Primary Examiner*—Matthew S. Smith
*Attorney, Agent, or Firm*—Foley & Lardner

[57] ABSTRACT

A fourth-unit tandem type color copier includes four photosensitive drums, a conveyor belt running, in a predetermined direction, in rolling contact with the respective drums, drum motors driving the corresponding drums, and a belt motor running the conveyor belt. Currents driving the drum motors and belt motor are so supplied as to be gradually stepped up from the starting of these motors and it is possible to lower a burden on a power source caused when the respective motors are started.

9 Claims, 5 Drawing Sheets

IMAGE FORMING APPARATUS

BACKGROUND OF THE INVENTION

The present invention relates to an image forming apparatus, such as a copier and printer and, in particular, to an image forming apparatus having a plurality of photosensitive drums for forming an image of developing agents of respective colors on the basis of a color-separated image signal and a conveying belt for supplying a recording sheet (transfer medium) past the respective photosensitive drums.

A four-unit tandem type color copier is known as an image forming apparatus for outputting a color image, the color copier forming toner images of the colors, for example, yellow (Y), magenta (M), cyan (C) and black (B) on the basis of a color-separated image signal and transferring these toner images on a recording sheet through the registration of the toner images on the recording sheet. This type of color copier has four photosensitive drums arranged, side by side, in a manner to be spaced apart a predetermined distance and allows four color toner images to be carried thereon and a conveyer belt for supplying the recording sheet past the four photosensitive drums. The conveying belt is stretched between a pair of mutually spaced-apart rollers and run in an endless fashion. The respective photosensitive drums are driven by corresponding individual motors and one of these rollers is also driven by its own motor.

The respective photosensitive drum and conveying belt a rearranged in a contacting relation and, if there occurs a difference in speed between the photosensitive drum and the conveyor belt, then one of the two is injured. In order to prevent any undesired friction caused by the speed difference, it is necessary to move the respective photosensitive drum and conveyor belt constantly in the same direction and at the same speed. For example, when the photosensitive drum and conveying belt are started, it is necessary to drive the two at the same timing. At the start of both the motors, therefore, a relatively great drive current is required.

In the fourth-unit tandem type color copier having the above-mentioned four photosensitive drums, in particular, there occurs an overlap in overshoot at the starts of the respective motors, thus exerting a greater burden on a power source unit of the copyer.

BRIEF SUMMARY OF THE INVENTION

It is accordingly the object of the present invention to provide an image forming apparatus which can reduce a burden on a power source involved at the starting of the apparatus.

In order to achieve the above-mentioned object, there is provided an image forming apparatus comprising:

a first motor for driving an image carrier;

developing agent image forming means for forming a developing agent image on the image carrier;

conveying means movable in contact with the image carrier to convey a transfer medium toward the image carrier;

a second motor for driving the conveying means;

transfer means for allowing the developing agent image which is formed by the developing agent image forming means on the image carrier to be transferred to the transfer medium conveyed by the conveying means; and control means for controlling the first and second motors with a first current value corresponding to a current supplied to these motors when the respective motors are started and with a second current value corresponding to a current supplied to the respective motors after a predetermined time has been passed from the starting of the motors, the second current value being greater than the first current value.

Further, an image forming apparatus is provided, comprising:

a plurality of juxtaposed photosensitive drums;

a plurality of first motors independently driving the corresponding photosensitive drums to allow these drums to be rotated in a predetermined direction;

developing agent image forming means for forming, based on color-separated image signals, developing agent images for respective colors as visible images on the surfaces of the respective photosensitive drums;

a conveyor belt movable in the predetermined direction in rolling contact with the photosensitive drums and, bearing a transfer medium, conveying the medium on the respective photosensitive drums;

a second motor for running the conveyor belt in the predetermined direction;

transfer means for allowing the developing agent images of respective colors which are formed by the developing agent image forming means on the surfaces of the photosensitive drums to be sequentially transferred in a registering relation to the transfer medium conveyed on the conveyor belt; and control means for controlling the first and second motors with a first current value corresponding to a current supplied to these motors when the motors are started and with a second current value corresponding to a current supplied to these motors after a predetermined time has been passed from the starting of the motors, the second current value being greater than the first current value.

Further, an image forming apparatus is provided, comprising;

a first motor for rotating photosensitive drum in a predetermined direction;

charging means for charging the surface of the photosensitive drum to a predetermined potential;

light exposing means, having a rotary polygon mirror continuously deflecting light beam corresponding to image signal, for scanning, with the light beam deflected through the rotary polygon mirror, the surface of the photosensitive drum charged with the charging means and, by doing so, forming electrostatic latent image on the surface of the photosensitive drum;

developing means for supplying developing agent to the electrostatic latent image on the surface of the photosensitive drum to effect development;

a conveyor belt movable in the predetermined direction in rolling contact with the photosensitive drum and, bearing a transfer medium, conveying the medium to the photosensitive drum;

a second motor for running the conveyor belt in a predetermined direction;

transfer means for enabling a developing agent image which is formed by the developing means on the surface of the photosensitive drum to be transferred to the transfer medium conveyed by the conveyor belt;

fixing means for fixing the developing agent image which is transferred by the transfer means to the transfer medium;

first control means for drive-controlling the first and second motors, the first control means having a drive section for driving the first and second motors with the supply of currents and a controller for supplying a current limit signal to the drive section to make the currents which are supplied to the first and second motors lower than the currents at the normal operation time at the starting of the motor so that the former currents stepwise approach the currents at the normal operation time; and second control means for, in accordance with a current control signal supplied from the controller, controlling the charging means, rotary polygon mirror, developing means and transfer means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments give below, serve to explain the principles of the invention.

DETAILED DESCRIPTION OF THE INVENTION

An embodiment of the present invention will be explained below with reference to the accompanying drawing.

Figure 1:
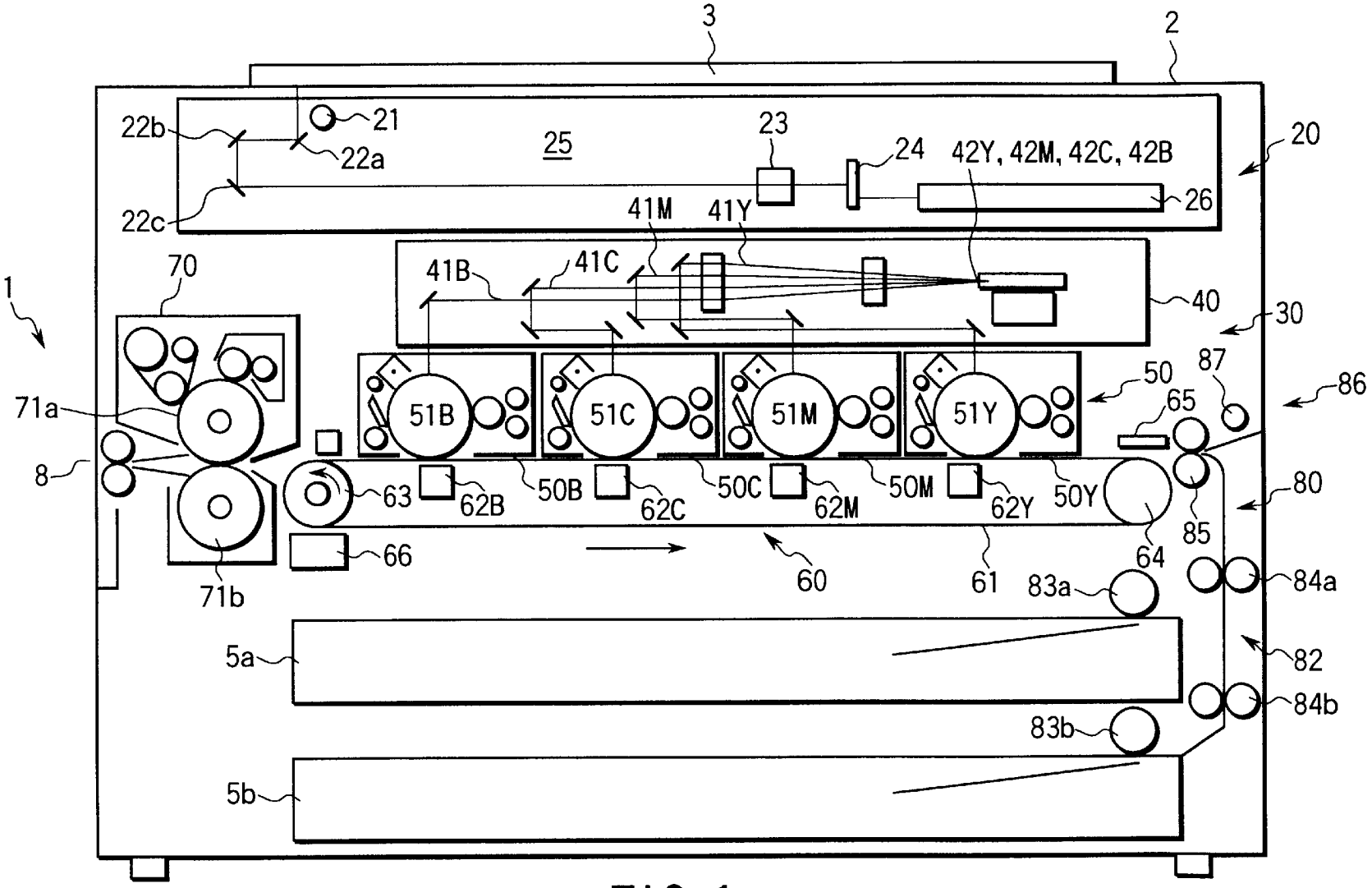
FIG. 1 is a cross-sectional view diagrammatically showing an inner arrangement of a color copier according to an embodiment of the present invention.
Figure 2:
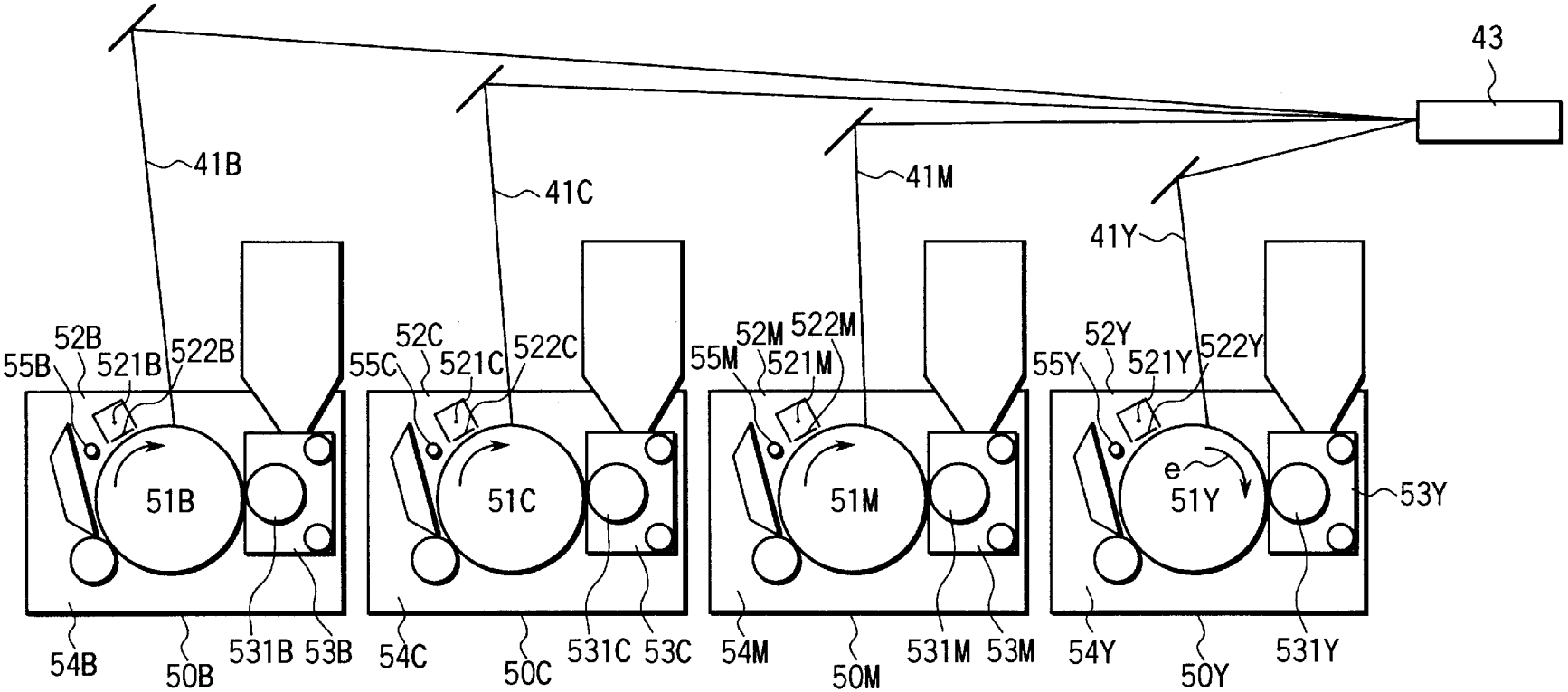
FIG. 2 is a view, partly enlarged, diagrammatically showing a major section of the color copier in FIG. 1.

FIG. 1 is a diagrammatic view showing an inner structure of a color copier 1 as an image forming apparatus of the present invention. FIG. 2 is an expanded view showing a major portion of the color copier 1 of FIG. 1.

The color copier 1 includes a document reading section 20 for reading a document image and converting it to an image signal, an image forming section 30 for outputting an image by an electrophotographic system, and a sheet conveying section 80 having sheet cassettes 5*a*, 5*b* and manual sheet feeding section 80.

The document reading section 20 includes an illumination lamp 21 for illuminating a document (not shown) on a document rest 2, a reflector means, not shown, for allowing light which comes from the illumination lamp 21 to converge at the document, an optical system 25 for allowing the light which is reflected from the document to be guided to a light receiving element 24 via reflection mirrors 22*a*, 22*b* and 22*c*, image forming lens 23, etc., the light receiving element 24, such as a CCD, for allowing the light which is guided through the optical system 25 to be converted to an electric signal, and an image processing device 26 for allowing the converted electric signal to be color-separated and image signals of the colors yellow (Y), magenta (M), cyan (C) and black (B) to be formed.

The image forming section 30 utilizing the known electrophotographic system comprises a light exposure device 40 for exposing, to light, photosensitive drums 51Y, 51M, 51C and 51B provided for the respective colors (yellow, magenta, cyan, black), a transfer mechanism 60, a fixing device 70 and so on.

The transfer mechanism 60 has an endless type conveyor belt 61 for conveying a recording sheet. The conveyor belt 61 is stretched between mutually spaced-apart drive roller 63 and driven roller 64. The roller 63 is rotated by a later-described-motor in a direction indicated by an arrow. The conveyor belt 61 is run at predetermined speeds in the arrow-indicated direction. A predetermined tension is applied, by a pressure applying mechanism not shown, to the driven roller 64 in a direction away from the drive roller 63 so as to keep the conveyor belt 61 not slack.

Further, the transfer mechanism 60 has transfer units 62Y, 62M, 62C and 62B facing the photosensitive drums 51Y, 51M, 51C and 51B, respectively. The respective transfer units are located inside the conveyor belt 61.

A sheet feed-in guide device 65 is provided above the conveyor belt 61 to feed the recording sheet onto the conveyor belt 61. A cleaning device 66 is provided relative to the conveyor belt 61 to clean the surface of the conveyor belt 61.

On the upper surface side of the conveyor belt 61 the image forming units 50Y, 50M, 50C and 50B are equidistantly arranged so as to form images of the colors yellow, magenta, cyan and block as viewed from the right side of the drawing.

The light exposure device 40 is provided over the image forming units and has laser light sources 42Y, 42M, 42C and 42B driven based on the image signals of the respective colors created at the image processing device 26. The respective laser light sources 42Y, 42M, 42C and 42B exit laser light beams 41Y, 41M, 41C and 41B, respectively, corresponding to color-separated image signals. The respective laser light beams illuminate the surfaces of the photosensitive drums 51Y, 51M, 51C and 50B, in the image forming units 50Y, 50M, 50C and 50B, respectively, through a polygon mirror 43 shown in FIG. 2 to provide electrostatic latent images corresponding to the image signals of the respective colors.

The respective image forming units 50Y, 50M, 50C and 50B are of a similar type and those images corresponding to the respective colors are formed by the known electrophotographic process.

As set out in more detail in FIG. 2, charging devices 52Y, 52M, 52C, 52B, developing devices 35Y, 53M, 53C and 53B, transfer devices 62Y, 62M, 62C and 52B (see FIG. 1), cleaning devices 54Y, 54M, 54C and 54B and discharging devices 55Y, 55M, 55C and 55B are provided, along the rotation directions of, and around, the photosensitive drums 51Y, 51M, 51C and 51B, respectively.

The charging devices 52Y, 52M, 52C and 52B have charging wires 521Y, 521M, 521C and 521B and charging grids 522Y, 522M, 522C and 522B, respectively. Further, the developing devices 53Y, 53M, 53C and 53B have developing rollers 531Y, 531M, 531C and 531B, respectively, near the photosensitive drums 51Y, 51M, 51C and 51B.

The fixing device 70 has a pair of heating rollers 71*a,* 71*b,* upper and lower, heated to a predetermined temperature and set at a predetermined pressure relative to each other, so that, when the recording sheet passes through the nip of the upper and lower rollers, the toner which is transferred to the recording sheet is fused and fixed to the recording sheet.

Below the transfer mechanism 60 the sheet cassettes 5*a,* 5*b* and sheet supplying section 82 are provided, the sheet cassette holding a plurality of stacked sheets and the sheet supplying section 82 being adapted to take the recording sheet from the sheet cassette and supplying it to the image forming section 30.

The sheet supplying section 82 includes sheet supply rollers 83*a,* 83*b* for picking up the recording sheet from the sheet cassette, conveying rollers 84*a,* 84*b,* for conveying the recording sheet onto the conveyor belt 61 and aligning rollers 85, 85 for adjusting the timing at which the recording sheet is supplied.

The manual sheet feeding section 86 is provided upstream of the aligning rollers 85, 85 to allow the manually fed recording sheet to be guided onto the conveyor belt 61. When the recording sheet is fed through the manual sheet feeding section 86, a pick-up roller 87 is rotated to allow the leading edge of the recording sheet to be fed onto the aligning roller pair 85.

The operation of the copier 1 thus constructed will be explained below.

First, when a copy start key, not shown, is operated, the document reading section 20 is started, the illumination lamp 21 is lighted and the optical system 25 is operated. The light which is reflected from the document passes through the optical system 25 and is received at the light receiving element 24 and, after being converted to an electric signal, sent to the image processing device 26.

The electric signal is split by the image processing device 26 into image signals of the colors yellow, magenta, cyan and block and sent to a writing image processing device, not shown.

The signal from the writing image processing device is sent to the light exposure device 40. At the same time, the photosensitive drums 51Y, 51M, 51C and 51B, conveying belt 61, developing rollers 531Y, 531M, 531C and 531B, fixing device 70, etc., start to move.

The recording sheet is picked up by the sheet supply rollers 83*a,* 83*b* at the sheet cassettes 5*a,* 5*b* or by the pick-up roller 87 at the manual sheet feeding section 86, conveyed by the conveying roller pair 84*a,* 84*b,* time-adjusted by the aligning rollers 85 and sent onto the conveyor belt 61.

The laser beams 41Y, 41M, 41C and 41B of the corresponding colors are exited, at the light exposure device 40, based on the image signals of the respective colors sent from the writing image processing device. The respective laser beams are deflected at the polygon mirror 43 to allow them to scan the corresponding photosensitive drums.

For example, the light exposure device 40 energizes the laser light source 42Y on the basis of a yellow image signal to allow it to exit a yellow laser beam 41Y. The photosensitive drum 51Y is uniformly charged by the charging device 52Y and scanned with the yellow laser beam 41Y to form an electrostatic latent image, thereon, corresponding to a yellow image signal.

The photosensitive drum 51Y, being rotated in a direction of an arrow e (see FIG. 2), has its electrostatic latent image developed by the developing device 53Y, so that a yellow toner image is formed on the drum surface.

The yellow toner image is transferred, by the transfer device 62Y, to the recording sheet through the conveyor belt 61.

Thereafter, the remaining yellow toner on the photosensitive drum 51Y is cleaned by the cleaning device 54Y.

Further, the drum 51Y is illuminated by the discharging device 55Y to uniformly lower a residual potential on the drum 51Y. And it is in readiness for the next electrophotographic process.

For the colors magenta, cyan and black, the corresponding image signal is sent to the corresponding light exposure device 40 and, in accordance with the image signal, the corresponding laser beam (41M, 41C, 41B) exits. And in the same process as the yellow image forming unit 50Y the corresponding image is formed in the corresponding image forming units.

During the above-mentioned image formation, the recording sheet, being conveyed by the conveyor belt, allows the toner images of the respective colors to be sequentially transferred thereto and it is separated from the conveyor belt 61 by a forced separation done by a curvature of the driver roller 63 or by a separation claw, not shown, and sent to the fixing device 70.

In the fixing device 70, the recording sheet is image-fixed by heat or pressure and is discharged via a discharge outlet 8 onto a discharge tray, not shown, which is provided outside the copier 1.

Figure 3:
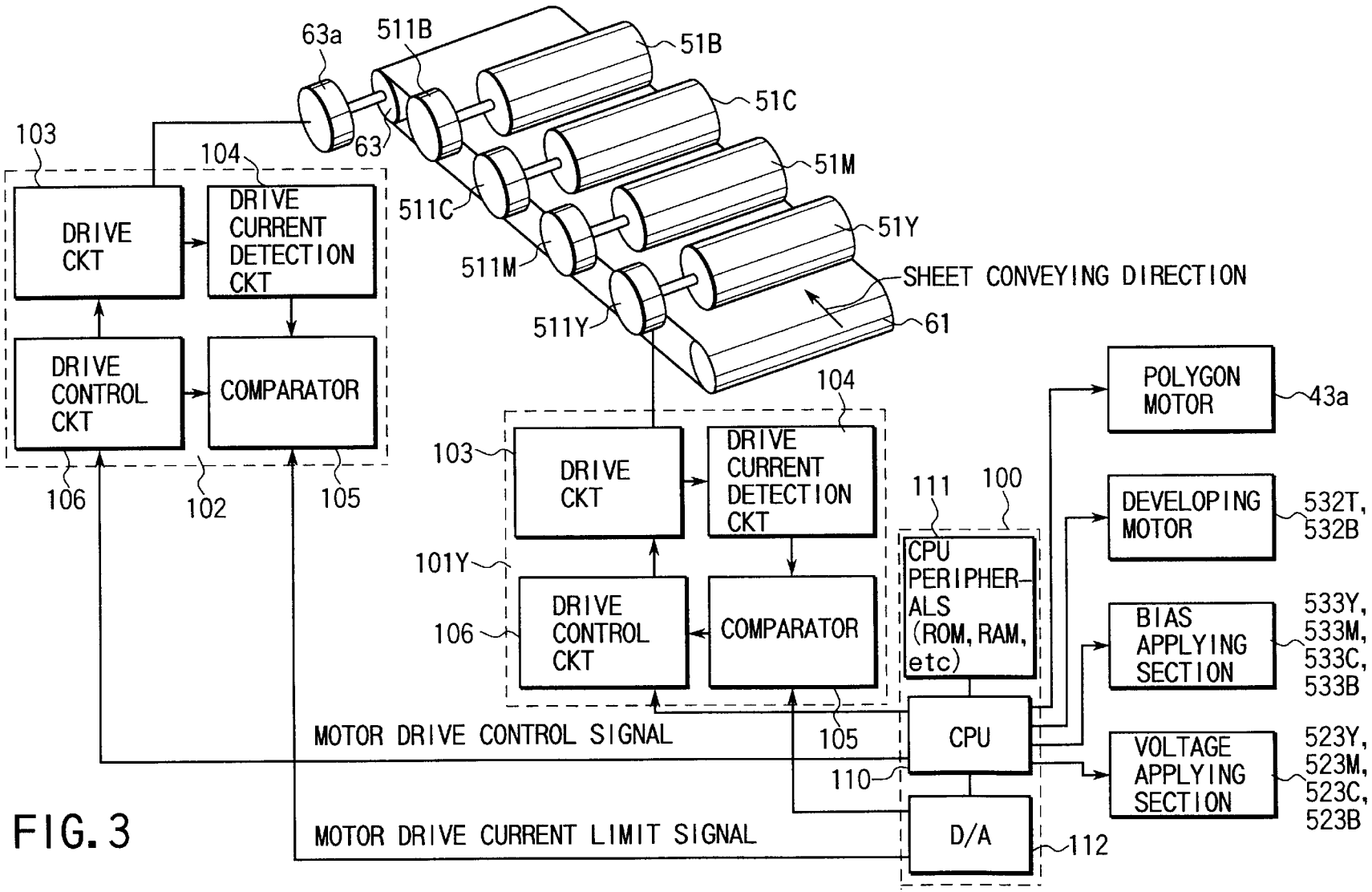
FIG. 3 is a view showing a control system for controlling a drum motor, belt motor and associated motors.

FIG. 3 shows the four photosensitive drums 51Y, 51M, 51C and 51B, the conveyor belt 61, set in rolling contact with the underlying conveyor belt 61, four drum motors 511Y, 511M, 511C, 511B rotationally driving the photosensitive drums, a belt motor 63*a* rotationally driving the drive roller 63 set on the conveyor belt 61 and a control system for controlling the respective motors.

Drive sections 101Y, 101M, 101C and 101B are connected to the drum motors 511Y, 51M, 511C and 511B, respectively, and a drive section 102 is connected to the belt motor 63*a.* For simplification in drawing, here, the drive section 110Y for yellow is represented as a drive section for the drum motor.

The respective drive sections 101, 102, each, comprise a drive circuit 103, a drive current detection circuit 104 for detecting a current through the motor and converting it to a voltage, a comparator 105 for comparing a detection voltage obtained from the drive current detection circuit 104 with an initially prepared reference voltage to generate a matching signal and a drive control circuit 106 for outputting a control signal to the drive circuit 103.

A controller 100 is connected to the drive sections 101 and 102 and includes a CPU 110 connected to the drive control circuits 106 of the respective drive sections 101, 102, CPU peripherals 111 such as ROM and RAM, and a D/A converter 112 connected to the comparators 105 of the drive sections 101, 102. It is to be noted that a motor drive control signal is output from the CPU 110 to the drive control circuits 106 of the drive sections 101 and 102. A motor drive current limit signal (hereinafter referred to simply as a limit signal) is output through the D/A converter 112 to the comparators 105 of the drive sections 101 and 102 so as to set a current value for driving the motors.

To the CPU 110 are connected polygon motor 43*a* for rotating the polygon mirror 43, developing motors 532T rotating the developing rollers 531Y, 531M, 531C, of the respective developing devices of the colors yellow, magenta and cyan, a developing motor 532B rotating the developing roller 531B of the developing device for black, bias applying sections 533Y, 533M, 533C and 533B applying developing biases to the corresponding developing rollers, charging wires 521Y, 521M, 521C and 521B of the respective charging devices, and voltage applying sections 523Y, 523M, 523C and 523B applying predetermined voltages to charging grids 522Y, 522M, 522C and 522B.

Although, here, the developing motors 532T, 532B rotating the developing rollers 531Y, 531M, 531C and 531B of the developing devices of the respective colors are provided separately from the drum motors 511Y, 511M, 511C and 511B, the developing motors can be omitted by connecting the drum motors to the respective developing rollers through a gear means or clutch means.

Figure 4:
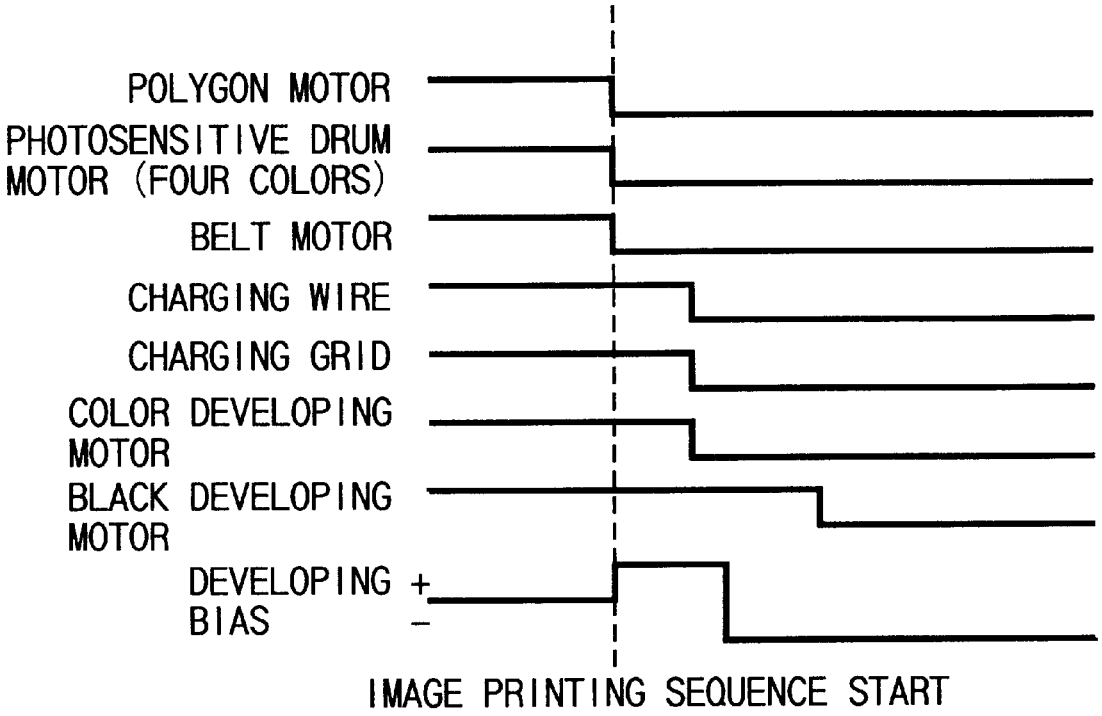
FIG. 4 PRIOR ART
FIG. 4 is a timing chart showing one form of a start sequence in a conventional color copier.

FIG. 4 shows a timing chart of one form of a start sequence of the respective associated parts at the start of the image forming operation by a conventional color copier.

In this sequence, the photosensitive drums of the respective colors and conveyor belts are simultaneously started at the starting timing of the image forming operation. That is, since the respective drums are rotated in rolling contact relation to the conveyor belt, the drums and conveyor belt have to be started at a time so as to prevent any damage, etc., caused by a sliding motion resulting from a mistiming between both.

Figure 5:
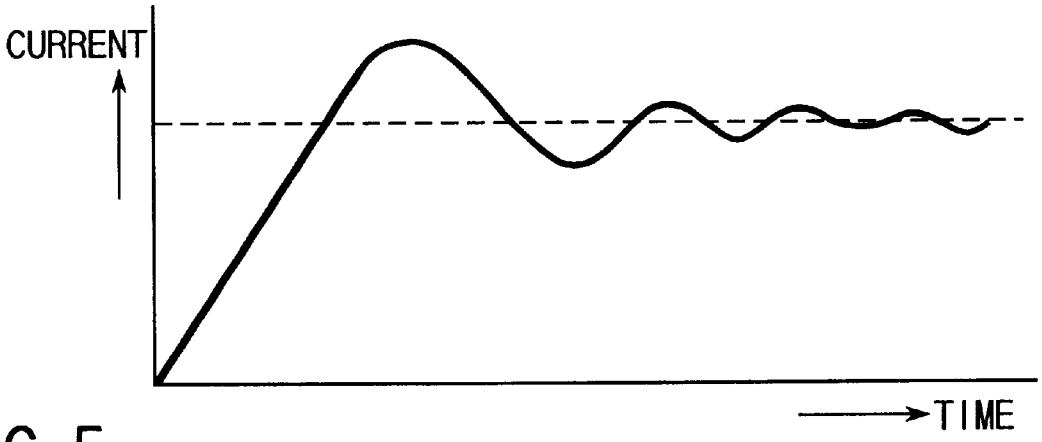
FIG. 5 is a graph showing the waveform of a current supplied at a start of a motor.

According to a four-unit tandem type color copier 1 of the present invention, if the machine is driven in accordance with the sequence as shown in FIG. 4, it is necessary to simultaneously drive the four drive motors 511Y, 511M, 511C, 511B and belt motor 63*a* and hence supply a very large current at the starting time. Generally, the characteristic of the current supplied at the starting time of the motor reveals an abrupt current jump at the rise time and a gradual converging toward a rated current as shown in FIG. 5. In consequence, if any current overshooting overlappingly occurs, for each motor, at the rise of such motor current, it is necessary to provide a very large starting current as the whole of the device and a greater burden is exerted on the power source of the copier.

Figure 6:
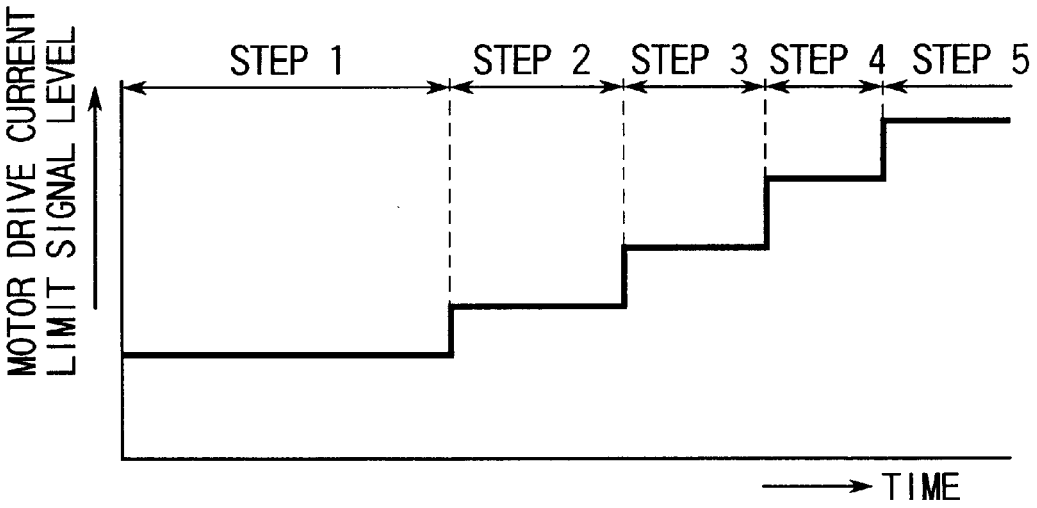
FIG. 6 is a graph showing a limit signal for limiting drive currents of a drum motor and belt motor in FIG. 5.

According to the present embodiment, therefore, at the start of the respective motor, a motor drive current is applied in a stepping-up relation as shown in FIG. 6. That is, at the start of the motor, the above-mentioned limit signal from the controller 100 is supplied to the drive sections 101 and 102 for driving the respective motors and, by doing so, the current value to be supplied to the respective motor is controlled stepwise.

In the present embodiment, other constituent devices of the color copier 1 are started so as to be matched to the respective steps of the above-mentioned motor drive current.

Figure 7:
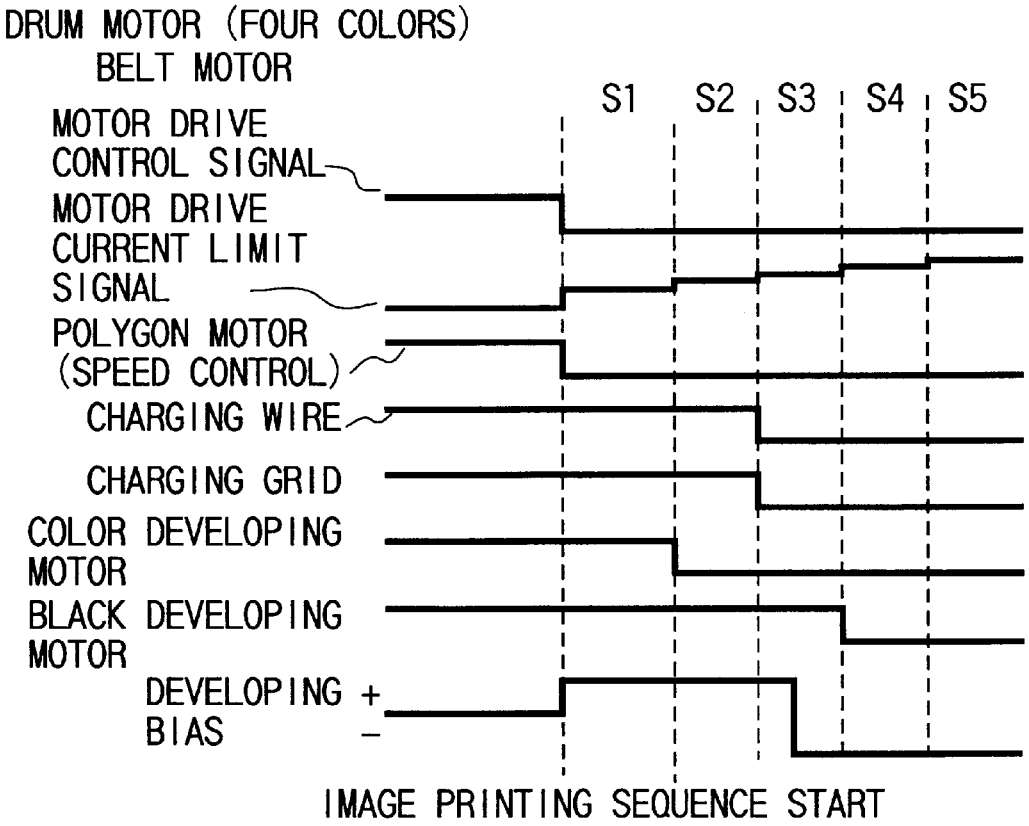
FIG. 7 is a timing chart showing a start sequence in the color copier of the present invention.

FIG. 7 shows a drive sequence of the color copier of the present invention.

When a sequence starting task is driven after the starting of the image forming operation, the step decision is made, followed by the processing of the respective steps.

In the processing at step 1, the processing data is read out and sets data, as a limit signal level, which corresponds to the step 1 processing. And the respective drum motors 511Y, 511M, 511C and 511B and belt motor 63*a* are started by a start current of a level based on the limit signal.

At the same time, at step 1, the polygon motor 43*a* is started (or speeded up) and a positive bias is applied as a developing bias to the developing rollers. Finally, a time up to the next step is set and the step 1 processing is ended. It is to be noted that the time from the step 1 processing to the next step processing is taken as being rather more time than another step processing time as will be set out below.

Subsequently, the time set by the step 1 passes and step 2 processing is executed. Here, after the reading out of the step data, a limit signal of a level corresponding to the step 2 processing is set and, by a current of a level raised in accordance with the limit signal, the drum motors 511Y, 511M, 511C and 511B and belt motor 63*a* are driven. At the same time, the developing motor 532T for the colors yellow, magenta and cyan is driven and a time up to the next step is set and the step 2 processing is ended.

Then, when the step 3 processing is executed, a limit signal of a level corresponding to the step 3 processing is set after the reading out of the step data. By a current of a level raised in accordance with this limit signal, the drum motors 511Y, 511M, 511C and 511B and belt motor 63*a* are driven. At the same time, a voltage is applied to the charging wires of the charging devices 52Y, 52M, 52C and 52B, as well as the corresponding charging grids, through the voltage applying sections 523Y, 523M, 523C and 523B. And a time up to the next step is set and the step 3 processing is ended.

Further, when step 4 processing is executed, a limit signal of a level corresponding to the step 4 processing is set after the reading out of the step data. By a current of a level raised in accordance with the limit signal, the drum motors 511Y, 511M, 511C and 511B and belt motor 63*a* are driven. At the same time, the developing motor 532B for black is driven and a time up to a sequential step is set and the step 4 processing is ended.

Finally, when the step 5 processing is executed, a limit signal of a level corresponding to the step 5 processing, that is, a level necessary to drive the associated motors, is set after the reading out of the step data and the respective drum motors 511Y, 511M, 511C and 511B and belt motor 63*a* are driven by a current of a level raised in accordance with the limit signal. And a step end flag for informing the user of the end of the respective steps is set and the step 5 processing is ended.

When the end of the step 1 to step 5 processing is decided, then the sequence start task is ended.

According to the embodiment of the present invention, as set out above, the current values for driving the drum motors 511Y, 511M, 511C and 511B driving the drums 51Y, 51M, 51C and 51B and the belt motor 63*a* running the conveyor belt 61 are gradually stepped up from the start time and those associated devices, such as the polygon motor 43*a,* developing motors 532T, 532B, bias applying sections 533Y, 533M, 533C, 533B and voltage applying sections 523Y, 523M, 523C, 523B are started in accordance with the steps.

It is, therefore, possible to lower a burden on a power supply caused by an overshoot, etc., at the start of a color copier 1.

The present invention is not restricted to the above-mentioned embodiment only and various changes or modifications can be made without departing from the spirit and scope of the present invention.

Additional advantages and modifications will readily occurs to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

I claim:

1. An image forming apparatus comprising:

a first motor for driving an image carrier;

developing agent image forming means for forming a developing agent image on the image carrier;

conveying means movable in contact with the image carrier to convey a transfer medium toward the image carrier;

a second motor for driving the conveying means;

transfer means for allowing the developing agent image which is formed by the developing agent image forming means on the image carrier to be transferred to the transfer medium conveyed by the conveying means; and control means for controlling the first and second motors with a first current value corresponding to a current supplied to these motors when the respective motors are started and with a second current value corresponding to a current supplied to the respective motors after a predetermined time has been passed from the starting of the motors, the second current value being greater than the first current value.

2. An image forming apparatus according to claim 1, wherein the second current value constitutes a current value at a normal operation state of the image carrier and conveying means.

3. An image forming apparatus according to claim 1, wherein the control means makes the currents which are supplied to the first and second motors set to normal operation currents by gradually stepping up the currents from the starting of the first and second motors.

4. An image forming apparatus according to claim 1, wherein the control means comprises a drive section for driving the first and second motors with the supply of currents; and a controller for enabling a current limit signal to be supplied to the drive section to make the currents which are supplied to the first and second motors lower than the currents at a normal operation time at the starting of the motors so that the former currents stepwise approach the current at the normal operation time.

5. An image forming apparatus comprising:

a plurality of juxtaposed photosensitive drums;

a plurality of first motors independently driving the corresponding photosensitive drums to allow these drums to be rotated in a predetermined direction;

developing agent image forming means for forming, based on color-separated image signals, developing agent images for respective colors as visible images on the surfaces of the respective photosensitive drums;

a conveyor belt movable in the predetermined direction in rolling contact with the photosensitive drums and, bearing a transfer medium, conveying the medium to the respective photosensitive drums;

a second motor for running the conveyor belt in the predetermined direction;

transfer means for allowing the developing agent images of respective colors which are formed by the developing agent image forming means on the surfaces of the photosensitive drums to be sequentially transferred in a registering relation to the transfer medium conveyed on the conveyor belt; and control means for controlling the first and second motors with a first current value corresponding to a current supplied to these motors when the motors are started and with a second current value corresponding to a current supplied to these motors after a predetermined time has been passed from the starting of the motors, the second current value being greater than the first current value.

6. An image forming apparatus according to claim 5, wherein the second current value constitutes a current value at a normal operation state of the photosensitive drums and conveyor belt.

7. An image forming apparatus according to claim 5, wherein the control means make the currents which are supplied to the first and second motors set to a normal operation state by gradually stepping up the current from the starting of the first and second motors.

8. An image forming apparatus according to claim 5, wherein the control means comprise a drive section for driving the first and second motors with the supply of currents; and a controller for enabling a current limit signal to be supplied to the drive section to make the currents which are supplied to the first and second motors lower than the current at a normal operation time at the starting of the motor so that the former currents stepwise approach the currents at the normal operation time.

9. An image forming apparatus comprising:

a first motor for rotating a photosensitive drum in a predetermined direction;

charging means for charging the surface of the photosensitive drum to a predetermined potential;

light exposing means, having a rotary polygon mirror continuously deflecting light beam corresponding to image signal, for scanning, with the light beam deflected through the rotary polygon mirror, the surface of the photosensitive drum charged with the charging means and, by doing so, forming electrostatic latent image on the surface of the photosensitive drum;

developing means for supplying developing agent to the electrostatic latent image on the surface of the photosensitive drum to effect development;

a conveyor belt movable in the predetermined direction in rolling contact with the photosensitive drum and, bearing a transfer medium, conveying the medium to the photosensitive drum;

a second motor for running the conveyor belt in a predetermined direction;

transfer means for enabling a developing agent image which is formed by the developing means on the surface of the photosensitive drum to be transferred to the transfer medium conveyed by the conveyor belt;

fixing means for fixing the developing agent image which is transferred by the transfer means to the transfer medium;

first control means for drive-controlling the first and second motors, the first control means having a drive section for driving the first and second motors with the supply of currents and a controller for supplying a current limit signal to the drive section to make the currents which are supplied to the first and second motors lower than the currents at a normal operation time at the starting of the motor so that the former currents stepwise approach the currents at the normal operation time; and second control means for, in accordance with a current control signal supplied from the controller, controlling the charging means, rotary polygon mirror, developing means and transfer means.

* * * * *